US006857432B2

(12) United States Patent
de Laforcade

(10) Patent No.: US 6,857,432 B2
(45) Date of Patent: Feb. 22, 2005

(54) COSMETICS PRODUCT AND MARKETING SYSTEM

(75) Inventor: Vincent de Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 114 days.

(21) Appl. No.: 09/902,265

(22) Filed: Jul. 11, 2001

(65) Prior Publication Data

US 2003/0010351 A1 Jan. 16, 2003

(51) Int. Cl.[7] ..... A45D 33/18; A45D 33/26

(52) U.S. Cl. ..... 132/294; 132/200; 206/457

(58) Field of Search ..... 132/200, 162, 132/73.5, 286, 293, 294, 295, 297, 301, 303, 304, 312, 314, 315, 316, 317, 333; 2/209.14, 279; 206/581, 281, 385, 457, 458, 459.1, 459.5, 823; D28/6, 79, 81, 87, 99

(56) References Cited

U.S. PATENT DOCUMENTS

| | | | | |
|---|---|---|---|---|
| 1,223,074 A | | 4/1917 | Kantrowitz | |
| 1,400,139 A | * | 12/1921 | Brosnan | 24/5 |
| 1,502,013 A | * | 7/1924 | Benois | 220/611 |
| 1,693,563 A | | 11/1928 | M2üller | |

(List continued on next page.)

FOREIGN PATENT DOCUMENTS

| | | |
|---|---|---|
| EP | 0 707 955 | 4/1996 |
| FR | 2 674 183 | 9/1992 |
| FR | 2 796 329 | 1/2001 |

OTHER PUBLICATIONS

Co–pending Application Attorney Docket No. 08048.0034–00000 Title: Article Comprising Composite Material and Method of Making the Article Inventor: Laure Bourjal U.S. Filing Date: Jul. 11, 2002.

English language Derwent Abstract of FR 2 796 329, Jan. 19, 2001.

Final Office Action issued by the USPTO, dated Aug. 11, 2003, in co–pending U.S. Appl. No. 09/902,092, filed Jul. 11, 2001.

Final Office Action issued by the USPTO, dated May 21, 2003, in co–pending U.S. Appl. No. 09/902,092, filed Jul. 11, 2001.

Amendment, filed Feb. 19, 2003, in co–pending U.S. Appl. No. 09/902,092, filed Jul. 11, 2001.

Office Action issued by the USPTO, dated Nov. 19, 2002, in co–pending U.S. Appl. No. 09/902,092, filed Jul. 11, 2001.

Response to Election of Species Requirement, filed Oct. 16, 2002, in co–pending U.S. Appl. No. 09/902,092, filed Jul. 11, 2001.

Office Action issued by the USPTO, dated Sep. 24, 2002, in co–pending U.S. Appl. No. 09/902,092, filed Jul. 11, 2001.

Co–pending U.S. Appl. No. 09/902,092; Attorney Docket No. 05725.0945 Title: Foam Core Cosmetic Case Inventor: Vincent De Laforcade U.S. Filing Date: Jul. 11, 2001.

English language Derwent Abstract of FR 2 674 183, Sep. 25, 1992.

*Primary Examiner*—Eduardo C. Robert
*Assistant Examiner*—David Comstock
(74) *Attorney, Agent, or Firm*—Finnegan, Henderson, Farabow, Garrett & Dunner, LLP

(57) ABSTRACT

A method involves making available a cosmetic product and a non-cosmetic product and offering one or more of the products for sale. The non-cosmetic product may have a visible portion including a first material chosen from fabric, facsimile of fabric, animal skin, and imitation animal skin. The cosmetic product may define at least one internal region configured to surround and contain least one cosmetic composition. A visible portion of the cosmetic product may include a second material chosen from fabric, facsimile of fabric, animal skin, and imitation animal skin. The first material may have an appearance resembling an appearance of the second material.

88 Claims, 19 Drawing Sheets

U.S. PATENT DOCUMENTS

| | | | | | |
|---|---|---|---|---|---|
| 2,035,384 | A | | 3/1936 | Hinchliff | |
| D124,653 | S | | 1/1941 | Kane | |
| D124,949 | S | * | 2/1941 | Botham | D28/79 |
| D126,813 | S | | 4/1941 | Karoff | |
| D157,793 | S | | 3/1950 | Salisbury | |
| 2,527,339 | A | | 10/1950 | Tamoschat | |
| D183,749 | S | | 10/1958 | Kent | |
| D183,750 | S | | 10/1958 | Kent | |
| 3,496,575 | A | * | 2/1970 | Neckermann et al. | 2/171 |
| 3,507,416 | A | | 4/1970 | Douglas et al. | |
| 3,858,718 | A | | 1/1975 | Roy | |
| 4,018,237 | A | | 4/1977 | Steiman | |
| 4,446,965 | A | | 5/1984 | Montiel | |
| 4,557,620 | A | | 12/1985 | Hancy | |
| 4,753,828 | A | * | 6/1988 | Francis et al. | 427/260 |
| D298,362 | S | | 11/1988 | Filiz et al. | |
| 4,816,000 | A | | 3/1989 | Hsu | |
| 4,884,704 | A | | 12/1989 | Spector | |
| 4,934,534 | A | | 6/1990 | Wagner | |
| 5,116,557 | A | * | 5/1992 | Debaes et al. | 264/46.6 |
| D330,853 | S | | 11/1992 | Koytuk | |
| 5,180,062 | A | * | 1/1993 | Stables | 206/574 |
| D351,487 | S | | 10/1994 | Chen | |
| 5,713,471 | A | | 2/1998 | Gueret | |
| 5,730,294 | A | | 3/1998 | Blosser et al. | |
| D403,123 | S | | 12/1998 | Sgariboldi | |
| 5,865,194 | A | | 2/1999 | Gueret | |
| 5,881,743 | A | * | 3/1999 | Nadel | 132/320 |
| 5,913,312 | A | * | 6/1999 | Donnell | 132/73 |
| 5,978,777 | A | | 11/1999 | Garnier | |
| 5,983,201 | A | | 11/1999 | Fay | |
| D417,932 | S | | 12/1999 | Siegel et al. | |
| D423,299 | S | | 4/2000 | Burrus | |
| 6,055,992 | A | * | 5/2000 | Skarne | 132/293 |
| D431,683 | S | | 10/2000 | Hillock | |
| 6,135,273 | A | | 10/2000 | Cuen | |
| D440,828 | S | | 4/2001 | Burrus | |
| 6,286,521 | B1 | * | 9/2001 | Joulia | 132/295 |
| 6,488,147 | B2 | * | 12/2002 | Mattesky | 206/278 |

* cited by examiner

COSMETICS PRODUCT AND MARKETING SYSTEM

BACKGROUND OF THE INVENTION

1. Field of the Invention

The invention relates to methods, combinations, apparatuses, and systems for establishing a marketing link between multiple related and unrelated products. In one example, the invention may be used to promote the sale of a cosmetic product through the sale of a non-cosmetic product (e.g., clothing), or vice versa.

2. Description of Related Art

Although the invention, in its broadest sense, is not limited to cosmetics and clothing, this patent uses the cosmetics-clothing example for purposes of conveying to the reader some of the principles of the invention.

Cosmetics and clothing are typically not sold together. In a department store, the points of sale for perfumes, mascaras, lipsticks, powders, and other cosmetics products often occur in a cosmetics department, while the points of sale for women's clothing, for example, are often in a women's clothing department. Stand-alone stores specializing in clothing sales typically do not have a cosmetics department, while stand alone cosmetic stores typically do not sell fashion clothing. As a result, cosmetics and clothing are not traditionally marketed together. Thus, even for companies that manufacture clothing and cosmetic lines, the realities of the retail distribution chain can make it difficult to cross-market products.

SUMMARY OF A FEW ASPECTS OF THE INVENTION

One aspect of the invention may involve a cosmetic product and a non-cosmetic product. Both may have a visible portion chosen from fabric, facsimile of fabric, animal skin, and imitation animal skin, such that they have appearances resembling each other. At least one of the products is preferably sold.

According to one aspect of the invention, a notification is provided to consumers to advise them of an existence of a matching product. The cosmetic product can be any cosmetic product (e.g., makeup product or care product), and the non-cosmetic product can be virtually any product (e.g., clothing). The cosmetic and non-cosmetic product can be distributed under differing brand name(s) or trademarks, or may be distributed under the same name(s) or mark(s).

According to one aspect, a marketing link may be established between the two products. In one sense it may be the notification mentioned above; in another sense, it may be that the aesthetic trademarks of the products are sufficiently similar that an ordinary or educated consumer would associate them with one another. The marketing link may be a label, sign, advertisement or provisional display associated with one or more of the products. Each product may be supplied by related or unrelated parties, and where appropriate a written or oral agreement may exist between the parties. The marketing link might also involve a promotional give-away, coupon, or internet campaign.

As described hereafter, other aspects of the invention exist, for example, in details of exemplary cosmetic and non-cosmetic product constructs, as well as the details of the cross-marketing schemes described. Thus, the summary of a few aspects of the invention is not to be interpreted as defining the invention.

DESCRIPTION OF EXEMPLARY EMBODIMENTS

Figure 2:
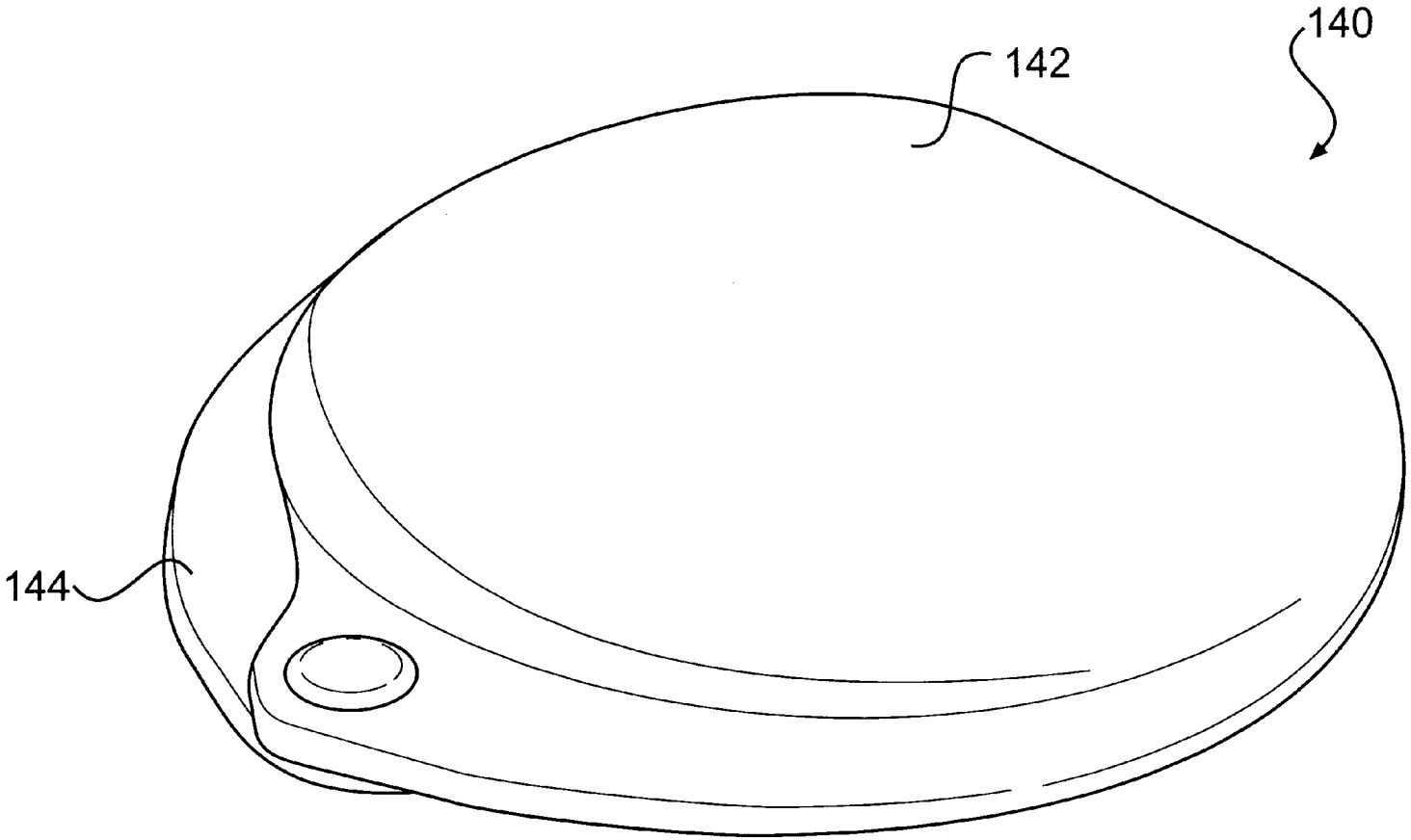
FIG. 2 is an oblique view of a second embodiment of a cosmetic case.
Figure 3:
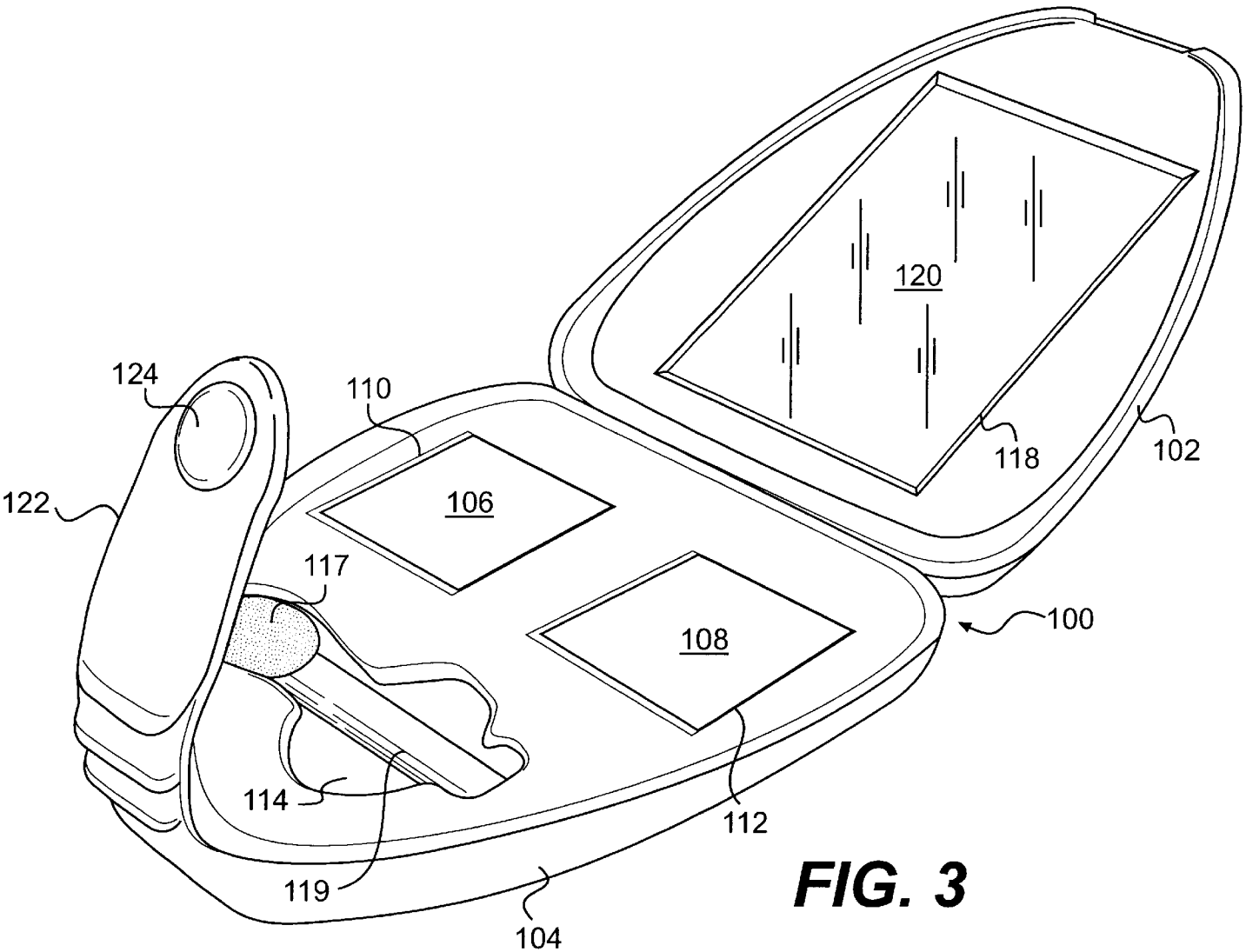
FIG. 3 is an oblique view of the first cosmetic case of FIG. 1, with an open cover.
Figure 4:
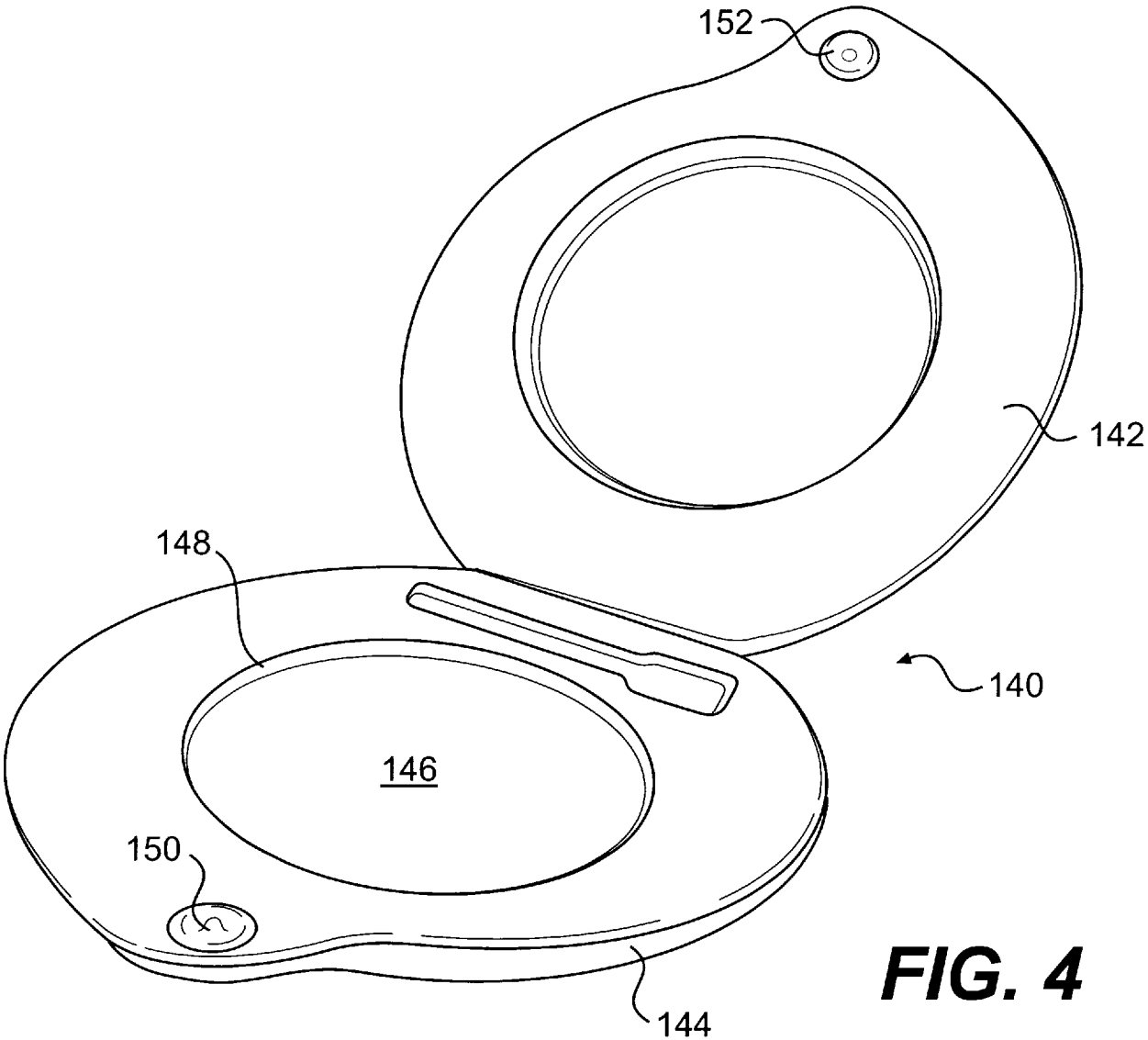
FIG. 4 is an oblique view of the second cosmetic case of FIG. 2, with an opened cover.

One exemplary method of the invention includes making available a cosmetic product defining at least one internal region configured to surround and contain at least one cosmetic composition. In accordance with this embodiment, the cosmetic product may include a container for containing a cosmetic composition (e.g., a makeup or care product) chosen from perfumes, colognes, lipsticks, mascaras, lipglosses, blushes, rouges, eye liners, foundations, powders, powder cakes, nail varnishes, eye shadows, and concealers, for example. The container may be made and shaped in conventional and unconventional ways, since, in its broadest sense, the invention is not limited to any particular container construction. Thus, byway of example only, compact cases 100 and 140 are respectfully illustrated in FIGS. 1 and 2. FIGS. 3 and 4 illustrate each compact case 100 and 140 with respective covers 102 and 142 opened with respect to bases 104 and 144. In FIG. 3, cosmetic powder cakes 106 and 108 are respectively located within internal regions or recesses 110 and 112 in base 104. Powder cakes 106 and 108 could be in direct contact with the portion of case 100 defining recesses 110 and 112, or alternatively, trays or other intermediate structures containing powder cakes 106 and 108 could be located (fixedly or removably) in recesses 110 and 112. The recesses are configured to surround and contain powder cakes 106 and 108. Analogously, as illustrated in FIG. 4, powder cake 146 is surrounded and contained within recess 148 in base 144. As used herein, references to material surrounding the cosmetic composition are to be understood to include the alternatives of directly surrounding the cosmetic substance, or surrounding a carrier or tray in which the cosmetic substance is contained.

Each of the illustrated cosmetic compacts may contain additional accoutrements. For example, as illustrated in FIG. 3, recess 114 in base 104 removably holds cosmetic applicator 116 having an applicator portion 117 configured to be loaded with the cosmetic composition, and a handling portion 119 configured to be grasped by a user. Similarly, recess 118 in cover 102 holds a mirror 120. If the invention is embodied in a method that involves mascara, nail varnish, or other liquid cosmetics, the cosmetic product may include a region configured in the form of a reservoir capable of containing a liquid cosmetic composition, and, optionally, also an applicator stored in the region.

Figure 1:
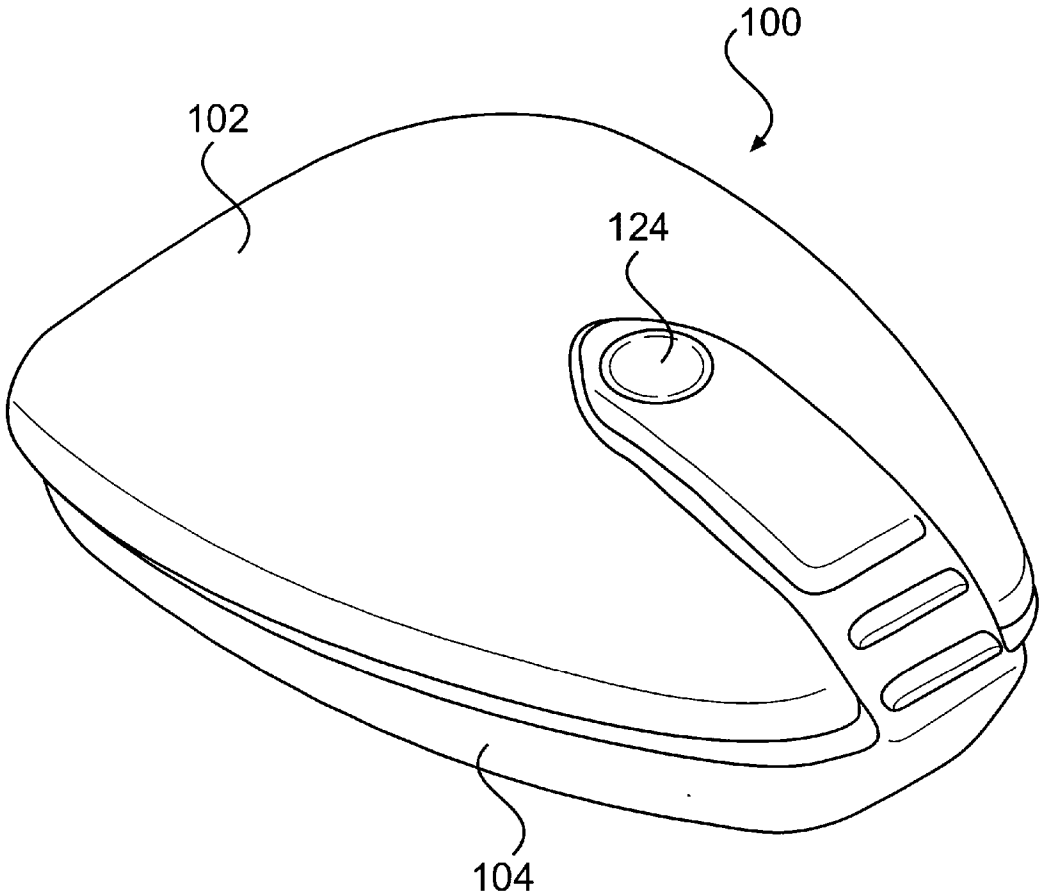
FIG. 1 is an oblique view of a first cosmetic case in accordance with an embodiment to the invention.
Figure 5A:
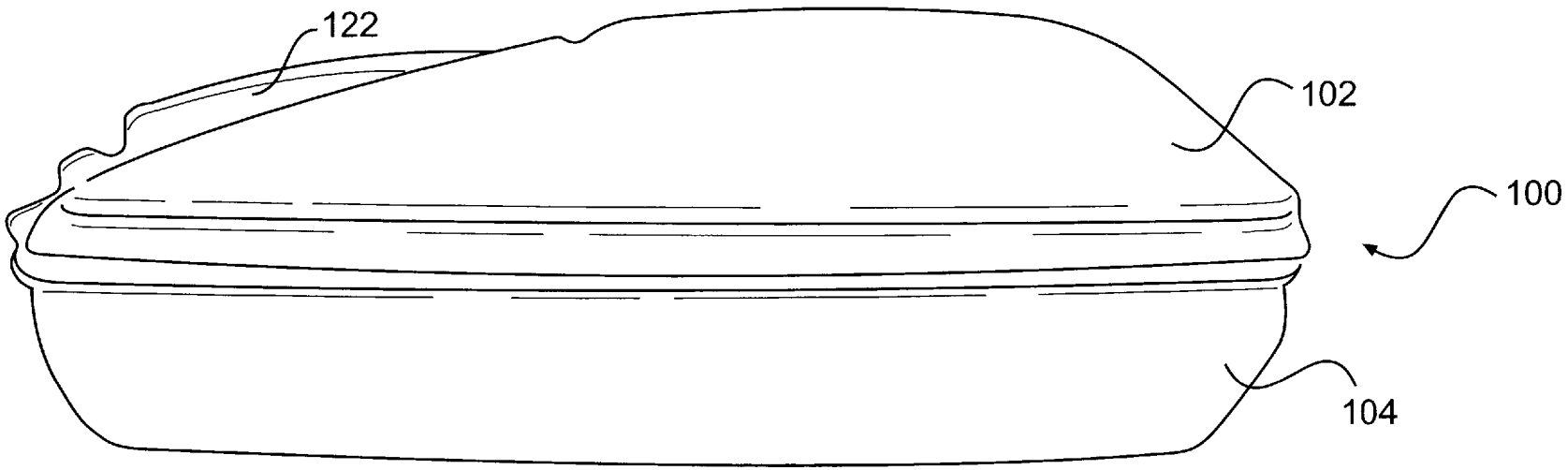
FIG. 5A is a side view of the cosmetic case of FIG. 1.
Figure 5B:
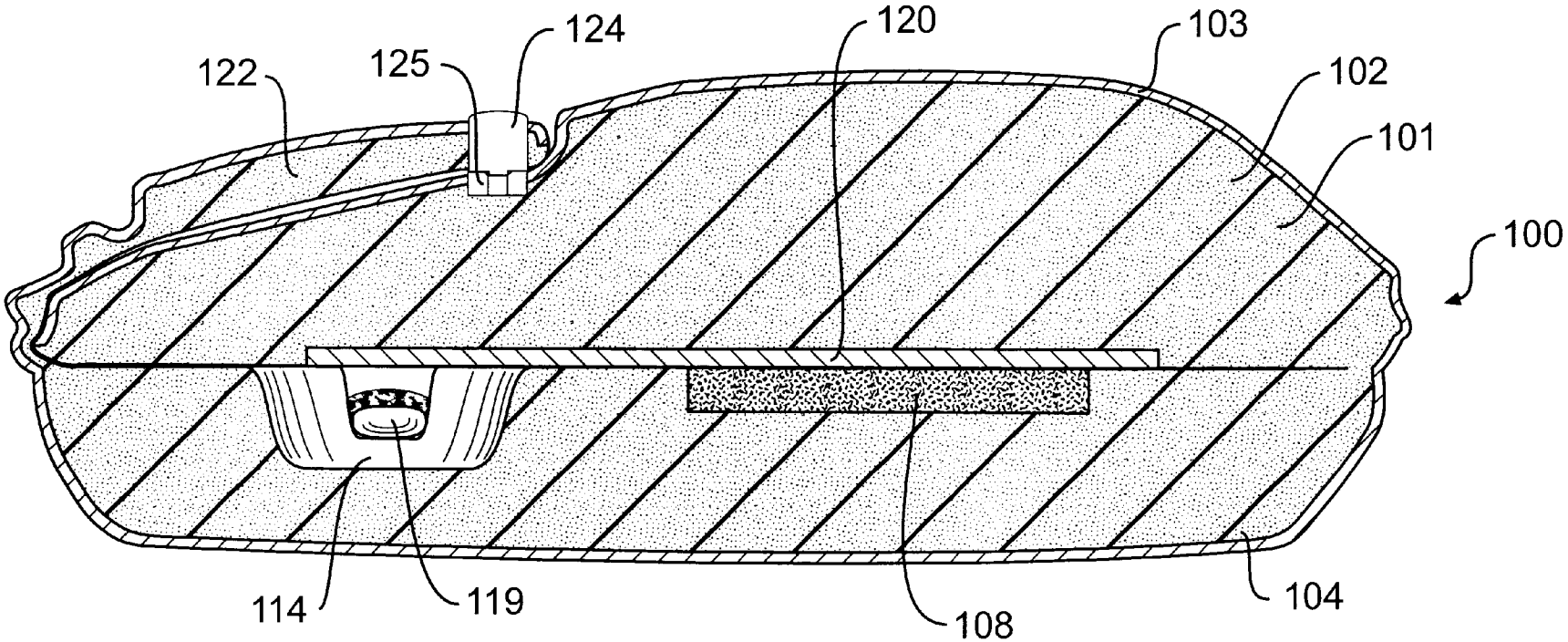
FIG. 5B is cross-sectional view of the cosmetic case of FIG. 1.

In FIG. 3, an elongated flexible closure mechanism 122 extends from base 104 and includes a snap 124 on a distal end thereof. The snap 124 fastens to a corresponding snap component 125 located on cover 102, when cover 102 is in a closed position, such as is illustrated in FIGS. 1 and 5B.

Figure 6A:
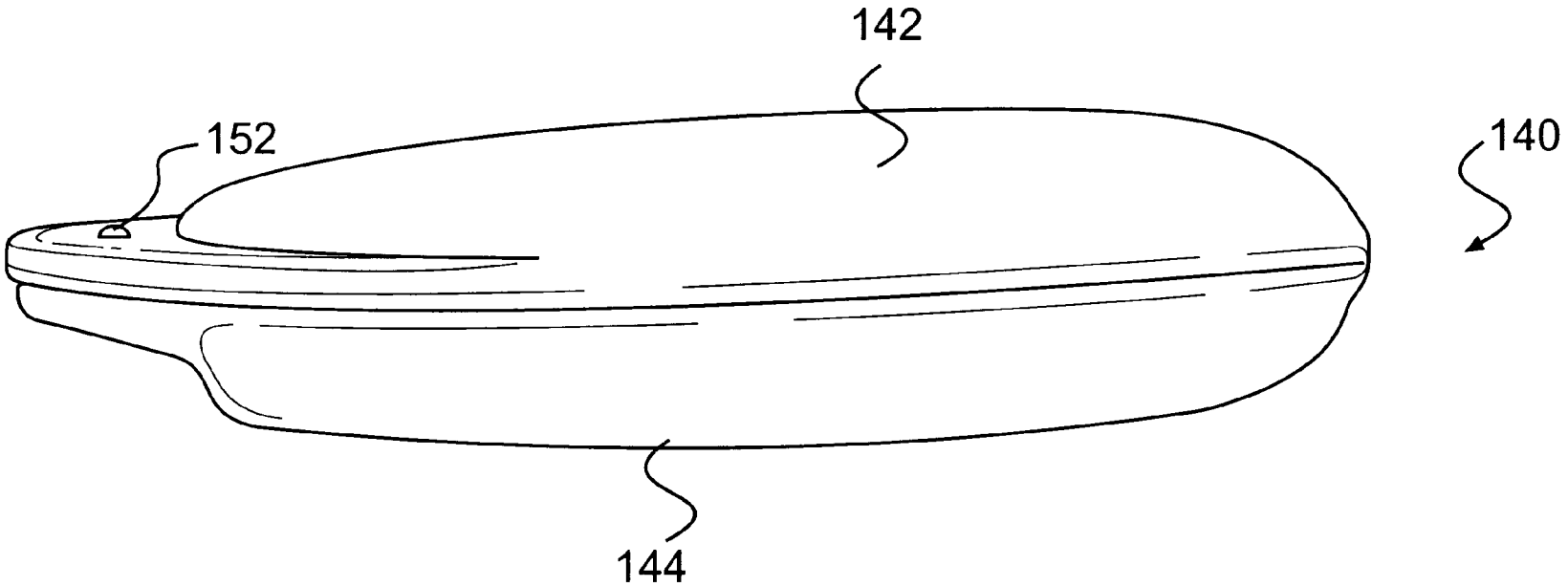
FIG. 6A is a side view of the cosmetic case of FIG. 2.
Figure 6B:
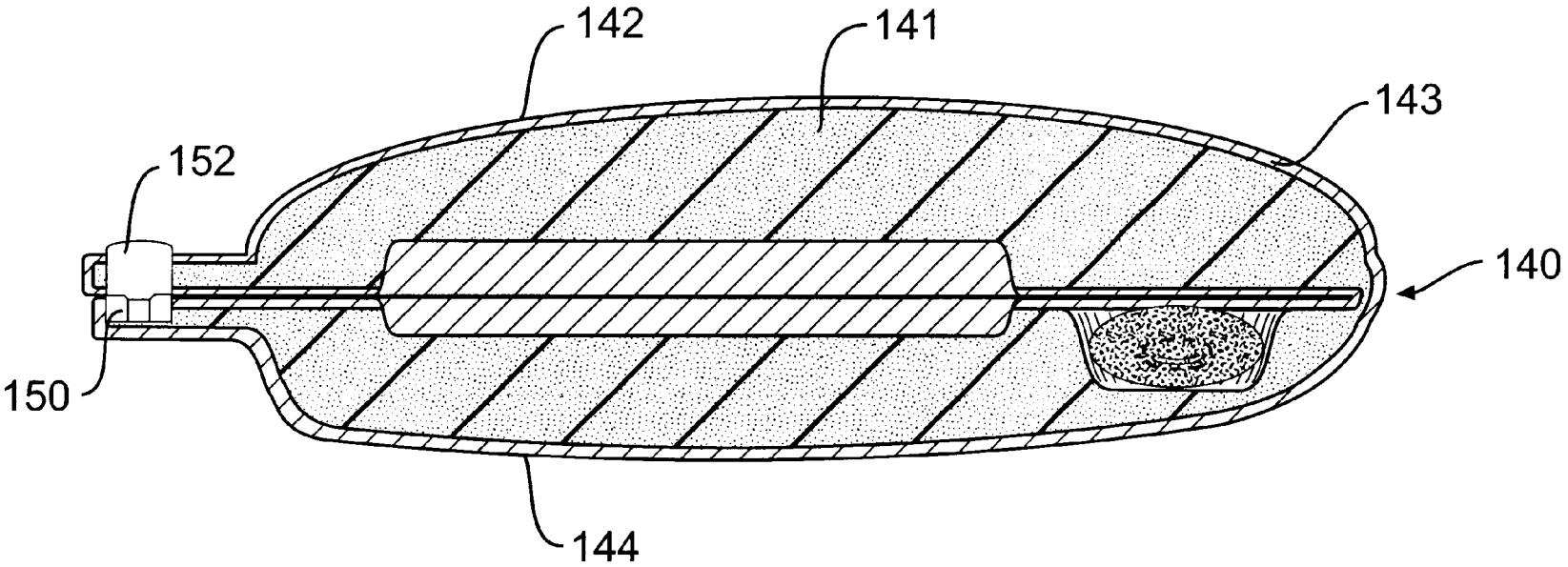
FIG. 6B is cross-sectional view of the cosmetic case of FIG. 2.

Similarly, as illustrated in FIGS. 2, 4, and 6A and 6B, a closure includes a fastener, the components of which are mounted on the cover and base. As illustrated in FIG. 4, first snap component 150 is located on base 144, and a second snap component 152 is located on cover 142. As best illustrated in FIG. 6B, portions of each snap component 150 and 152 are embedded in the material of the cover 142 and the base 144.

The closure mechanisms are illustrated as exemplary only, and may include any type of fastening device including magnets, Velcro, latches, detentes, or any other type of mechanical closure mechanism.

One exemplary method of the invention also involves making available a non-cosmetic product. In accordance with this embodiment, the non-cosmetic product may be any good that is not traditionally considered a cosmetic. Examples include shoes, jackets, skirts, dresses, slacks, pants, socks, shirts, blouses, bathing suits, suits, ties, undergarments, hats, and any other clothing article. Further examples of non-cosmetic products include purses, belts, bags, scarves, jewelry, watches, hair accessories, headbands, hair clips, barrettes, hair scrunches, and any other fashion accessory. Non-cosmetic products may also include sporting goods and sporting goods equipment carriers such as golf accessories, golf bags, rackets, and racket bags. Additional the non-cosmetic products may include luggage, car seats, towels, bedding items, sheets, blankets, toiletry bags, and other household goods. The above listings are not intended to be inclusive, it being understood that non-cosmetic products, as used herein, is intended to cover any product that is not a cosmetic.

An exemplary embodiment of the invention includes "making available" both the cosmetic and non cosmetic products. As used herein, the term "making available" refers to one or more of manufacture, manufacturer's distribution, wholesale distribution, retail distribution, promotional distribution, and other forms of distribution, sale, or provision. The term "making available" also refers to the display of a product, whether it be through promotional display, electronic commerce display, or point of sale notifications. An entity may make a product available if that entity cooperates with another who directly or indirectly distributes, sells, promotes or advertises a product. Thus, for example, a cosmetic product may be made available by a clothing manufacturer if the clothing manufacturer enters into an agreement or otherwise cooperates with the cosmetic manufacturer whereby each manufactures and distributes their own product to the benefit of the other, as is discussed in more detail below.

The first exemplary embodiment of the invention, in its broadest sense, does not necessarily require that the cosmetic and non-cosmetic products be provided in the same way. For example, retail distribution may be used for the cosmetic product while promotional distribution may be used for the non-cosmetic product. One product may be sold in a brick and mortar store, while the other might be made available through electronic commerce.

In accordance with an exemplary method of the invention, both the cosmetic product and the non-cosmetic product may have a visible portion comprising a first material chosen from fabric, facsimile of fabric, animal skin, and imitation animal skin. The term "fabric" generally refers to any woven material including fibers, any non-woven material including fibers, and, in its broadest sense, even sheet-like materials lacking fibers, for example. The term "facsimile of fabric" includes any type of material having a visual appearance made to resemble a fabric. The term "animal skin" includes animal hides, such as leather, or any animal fur. The term "imitation animal skin" includes any type of material having a visual appearance resembling animal skin, such as imitation leather or imitation animal fur or materials containing images of the same such as through printing or other techniques.

Figure 7A:
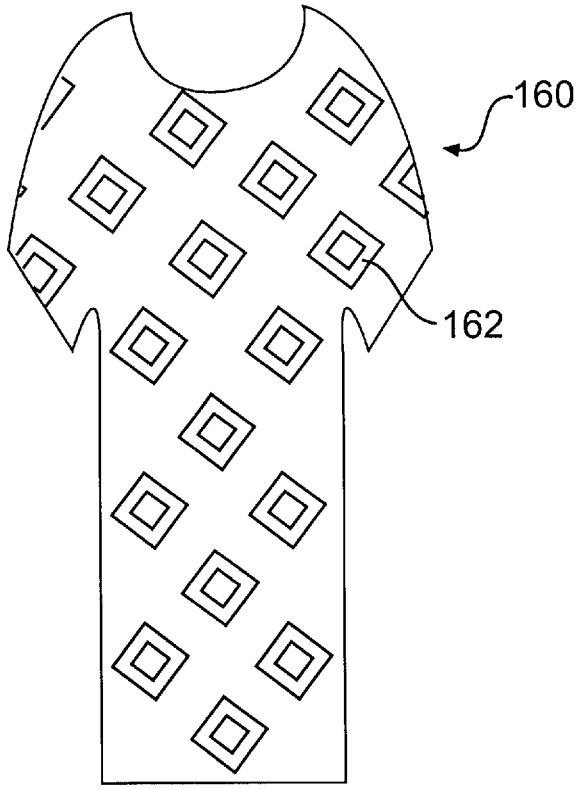
FIGS. 7A–7F illustrate various examples of clothing and cosmetic products sharing similar aesthetic properties in accordance with the present invention.
Figure 7B:
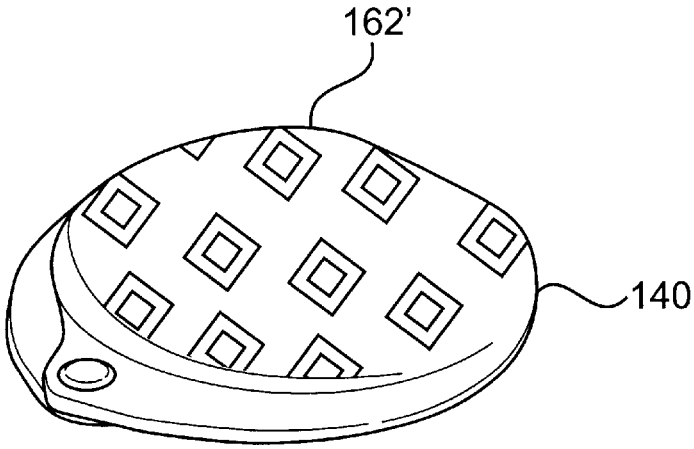

As illustrated, for example, in FIG. 7A, a non-cosmetic product such as garment 160 includes an outer fabric with a pattern 162 thereon. The pattern 162 may be woven, printed, provided by appliqué, or provided in any conventional or non-conventional manner. A replica 162' of pattern 162 may be reproduced on cosmetic case 140 as illustrated in FIG. 7B. The replica 162' may be a facsimile of fabric 162, such as may be provided through various printing techniques, or pattern 162' may be provided by using the same fabric on cosmetic case 140 as is used in garment 160.

Figure 7C:
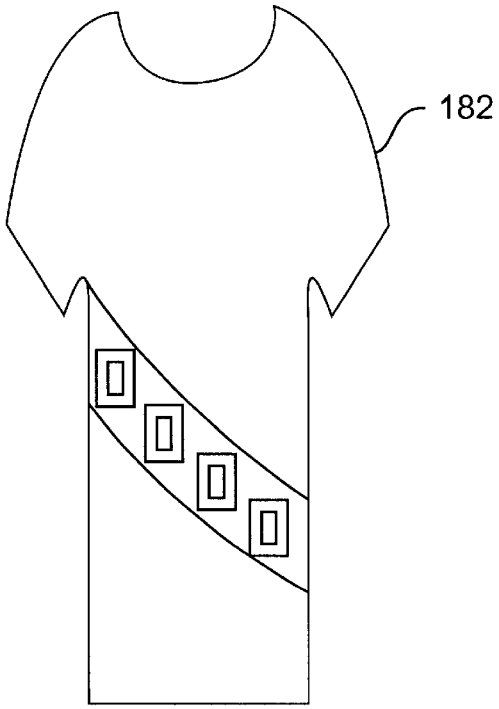
Figure 7D:
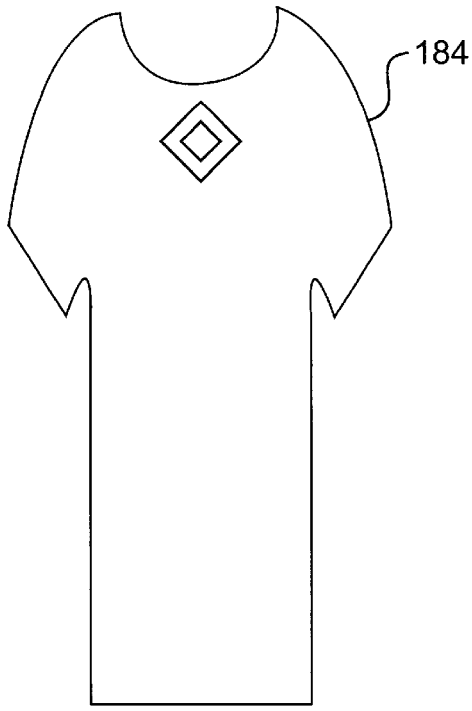
Figure 7E:
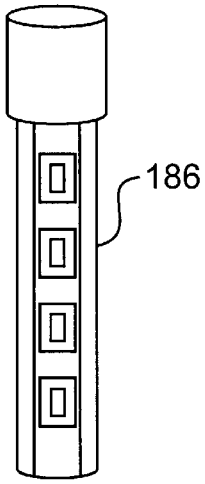
Figure 7F:
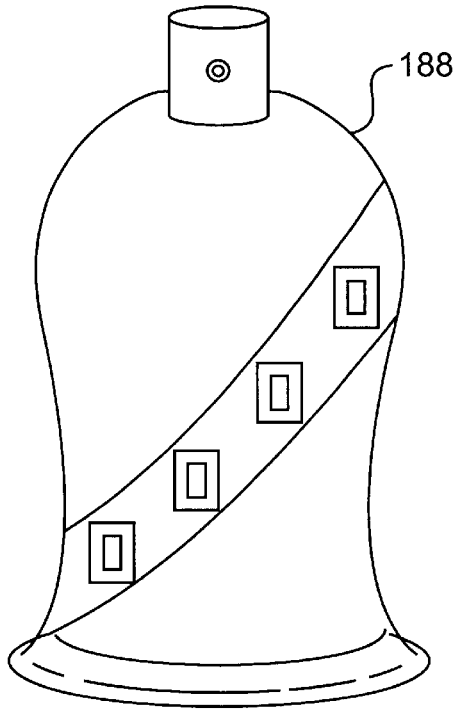

In exemplary embodiments of the invention, two products are said to either resemble each other or share similar aesthetic properties. This terminology is used herein to be inclusive of the gamut of similarities—from products that convey similar visual themes, to simulations, to precise identity. FIG. 7 is illustrative. FIGS. 7A and 7B are intended to convey the notion that precisely the same fabric may be used on two separate products, such that the visual aesthetic properties of at least portions of the two products are substantially identical. FIG. 7C illustrates a diagonal band of pattern on garment 182 similar to the pattern on the cosmetic case illustrated in FIG. 7B. Similarly, FIG. 7D reproduces a smaller portion of the pattern on garment 184. In FIGS. 7E and 7F, various configurations of similar patterns are illustrated on cosmetic cylinder 186 and fragrance bottle 188. Thus, while the representations of FIGS. 7A–7F each represent a visible aesthetic property in different manners, within the context of the invention, all of the representations illustrated in FIGS. 7A–7F are to be considered as resembling each other and sharing similar aesthetic properties.

Figure 9A:
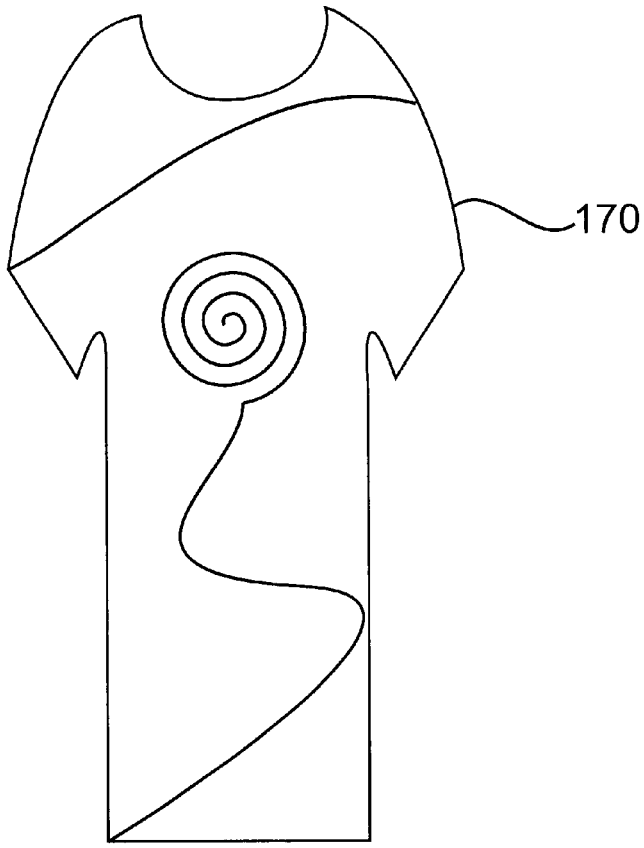
FIGS. 9–15 illustrate various additional examples of products sharing similar aesthetic features in accordance with the invention.
Figure 9B:
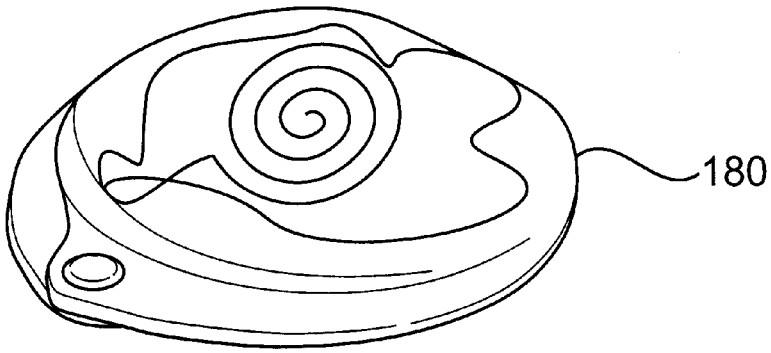
Figure 10A:
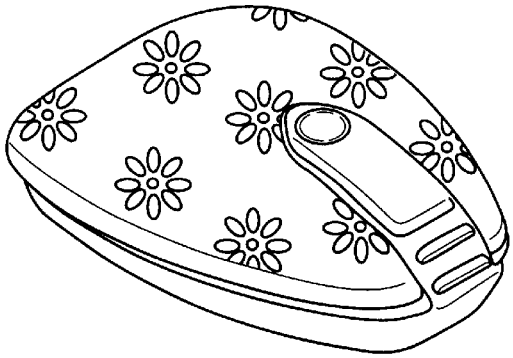
Figure 10B:
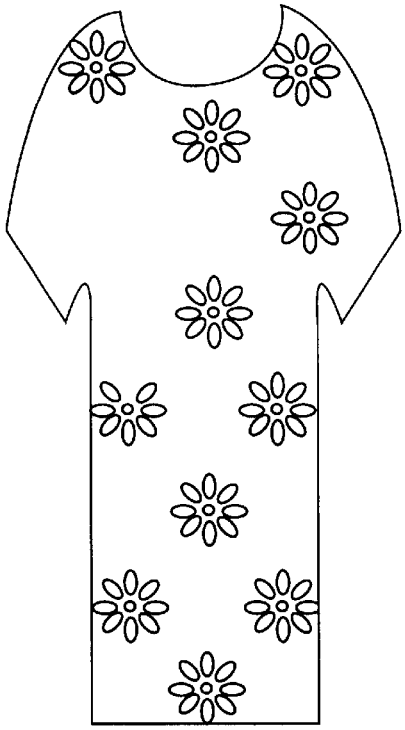
Figure 11A:
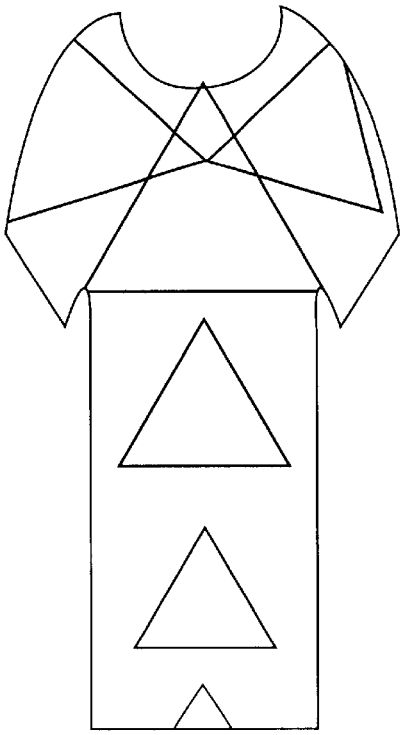
Figure 11B:
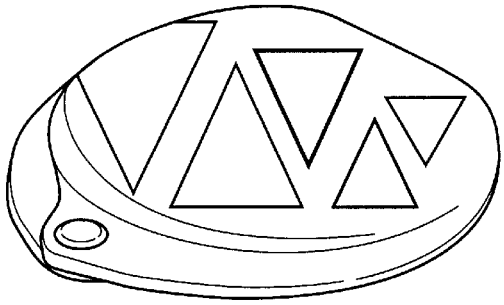
Figure 12A:
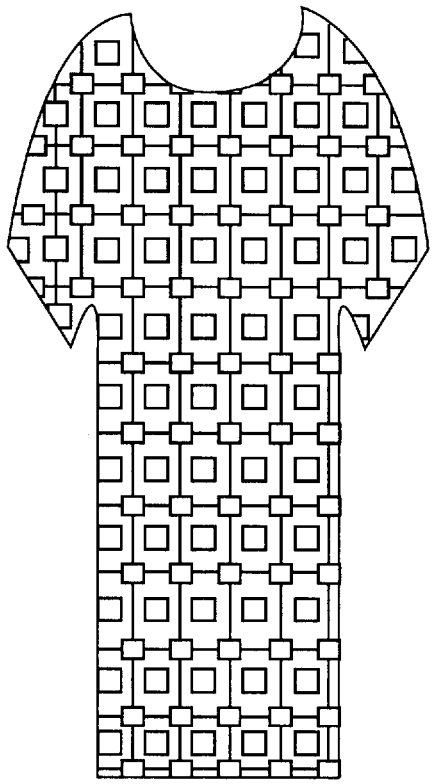
Figure 12B:
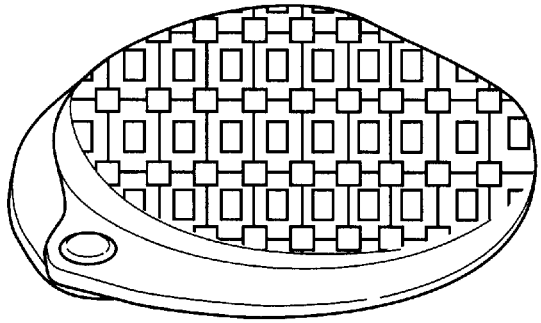
Figure 13A:
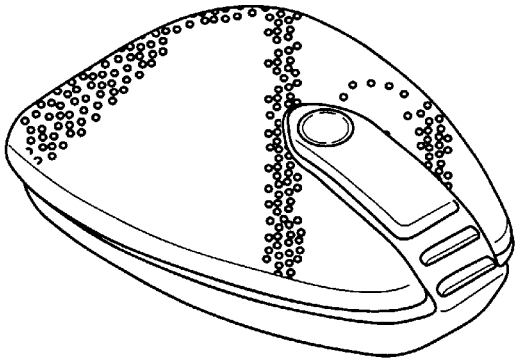
Figure 13B:
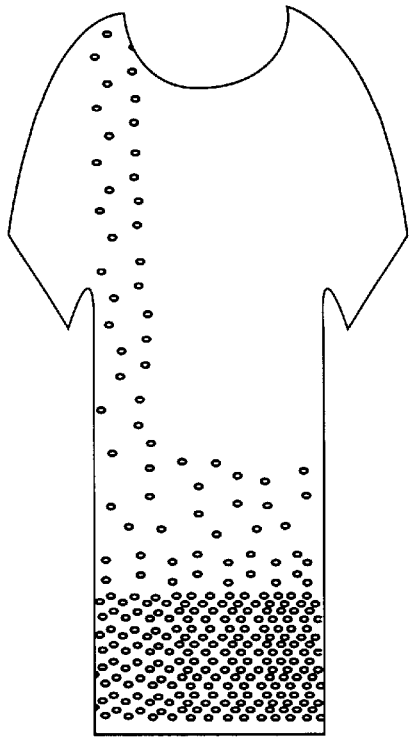
Figure 14A:
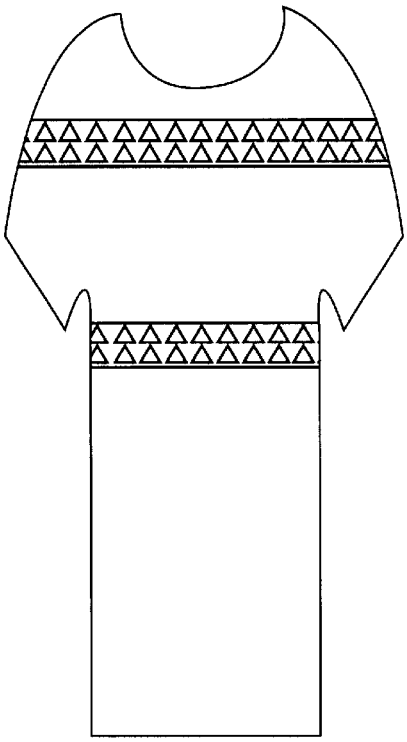
Figure 14B:
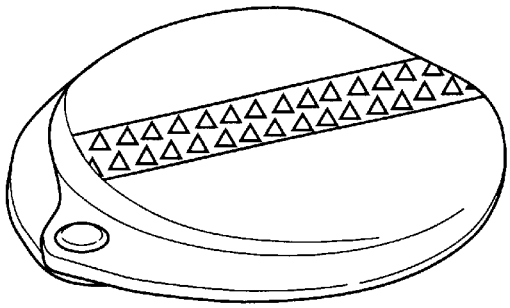
Figure 15A:
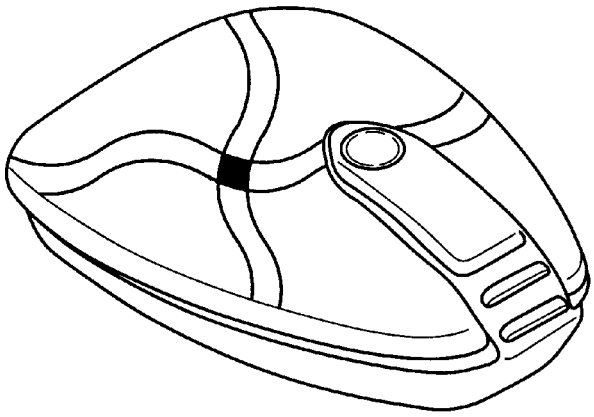
Figure 15B:
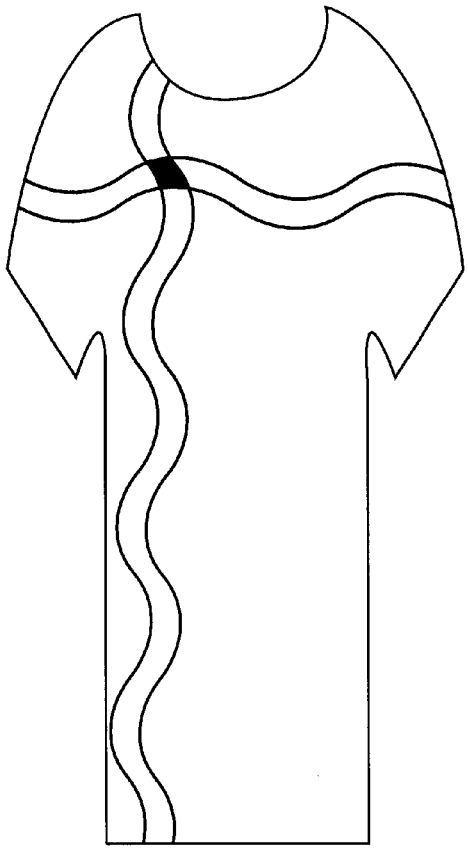

Importantly, precise identity is not required. Rather, the first material used on the non-cosmetic product and the second material used on the cosmetic product may only appear to resemble each other. For example, the first material and the second material may have appearances resembling each other in one or more of color, pattern, texture, or theme. Thus, the pattern of the fabric of garment 170 in FIG. 9A is not necessarily precisely the same as the pattern of the fabric of cosmetic case 180 in FIG. 9D. Nevertheless, the two have appearances resembling each other and are therefore within the scope of the invention.

In addition, as illustrated in FIGS. 7 and 8, the resembling materials on the cosmetic product and the non-cosmetic product do not necessarily need to cover a substantial visible portion of the product. For example, in FIG. 7C, the fabric pattern is merely a band of fabric on garment 182. In FIG. 8D, a small appliqué of fabric is applied in one location on garment 184. FIG. 7E illustrates a cosmetic cylinder 186 such as a lipstick or mascara container, with the pattern replicated in a vertical band. Similarly, in FIG. 7F, a perfume or cologne container 188 is illustrated with the pattern replicated in a diagonal band.

Figure 8A:
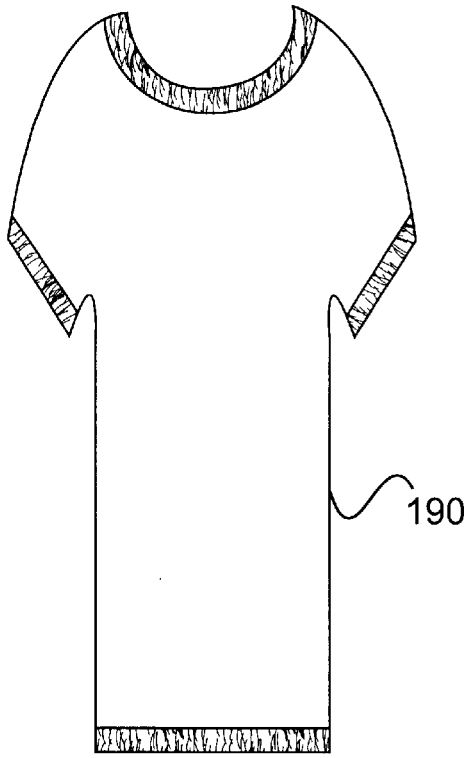
FIGS. 8A–8C illustrate other examples of cosmetic and clothing products sharing similar aesthetic features in accordance with the invention.
Figure 8B:
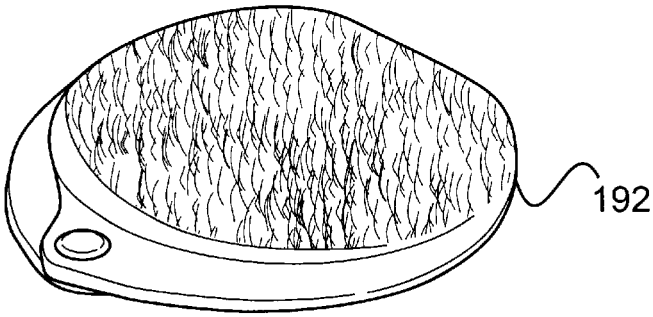
Figure 8C:
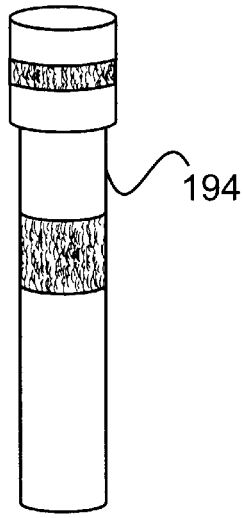

FIG. 8A illustrates a garment 190 having a fur or faux fur accent along edges thereof. Either the same fur, or a simulation of the same fur may be provided on a cosmetic case 192 such as illustrated in FIG. 8B, or on a cosmetic tube 194, as illustrated in FIG. 8C. Other animal skins such as leather may also be used. Again, the concept is not that the two products necessarily have the identical appearance, but rather that they convey a similar visual theme so that consumers are likely to associate the two products with each other. FIGS. 9–15 illustrate a few other examples of products that resemble each other, sharing similar visible aesthetic properties.

In accordance with the invention, one of the non-cosmetic product and the cosmetic product may be offered for sale. The offer for sale may be made via a manufacturer, a distributor, a reseller, a wholesaler, or a retailer. The cosmetic and non-cosmetic products may be offered for sale alone in the same or separate locations, or may be offered for sale as an ensemble.

The invention may also include establishing a marketing link between the cosmetic and the non-cosmetic product. The marketing link may take one of a number of forms. For example, one or more manufacturers or distributors of the cosmetic and non-cosmetic products may arrange to provide at the point of sale, information to the purchaser of at least one of the cosmetic and non-cosmetic product, the information advising the purchaser of an existence of a matching other product. In this way, the consumer receiving the information may be motivated to purchase the other matching article. The information provided to the consumer as part of the marketing link, may include an offer for purchase of the other product at a reduced price, or may include an incentive to purchase one product, and thereby receive the other product free of charge. The marketing link may include a coupon for the purchase of the other product.

Alternatively, although not mutually exclusive of any other mechanism, the marketing link may include an advertising campaign that refers to the cosmetic and the non-cosmetic product within a single advertisement. The advertisement may take the form of printed ads, signs, mailings, fliers, product labels, e-mail, website pages, web casts, audio broadcasts, analogue and digital video broadcast, television and radio broadcasts and promotional displays. Preferably, the advertisement advises the consumer of the existence of matching cosmetic and non-cosmetic products, to thereby explicitly or implicitly encourage the consumer to purchase both products.

The marketing link may include labels associated with one or more of the products. For example, labels may be secured to the product or the product packaging to thereby notify a consumer of a matching product. Alternatively, the manufacturer, distributor or other seller may provide a display sign to be posted at the point of sale, notifying the consumer of a matching product. As another alternative, the manufacturer/distributor/seller may provide notification to purchasers by directing them to a website or other electronic location containing further information about matching products.

The notification may include an incentive to the purchaser to obtain the other product. The incentive may include a coupon or other offer to obtain the product at a discounted price. The marketing link may include an offer to sell the other product at a reduced price, or an offer to provide the other product free of charge as an incentive to purchase the first product.

In an even broader sense, the marketing link may simply be that the two products employ a visual aesthetic property that is sufficiently unique to the two products that an ordinary or educated consumer who views the two products either side-by-side and/or at different times may be inclined to make a visual connection between the two products.

The matching products need not necessarily be sold under the same brand name. For example, the cosmetic product may be sold under a first brand name or trademark such as L'Oreal, while the non-cosmetic product may be sold under a second brand name of trademark, such as Ralph Lauren. Alternatively, the two products could be sold and/or distributed under single brand name or trademark, or under a plurality of brand names or trademarks whether they be commonly owned or owned by different entities in cooperation with each other. Brand marks may be contained on the product itself, on the product packaging, or may be omitted from the product and may be otherwise associated with the product at the point of sale.

The cosmetic and non-cosmetic product may be sold in a physical retail establishment or over an electronic network, such as the Internet. The products may both be sold in the same store, in different departments within the same store, or in different stores. Similarly, the products may be sold on the same Internet website, different portions of the same website, or different websites altogether. Alternatively, one product may be offered in a physical store while the other may be offered in an electronic forum.

While the various figures illustrate the first and second materials located on an external portion of cosmetic and non-cosmetic products, in its broadest sense, the invention is not so limited. Rather, it may be sufficient for the material to be located on a non external portion of the product visible to the consumer. For example, the material may be located on the inside of a cosmetic case visible when the cosmetic case is opened.

From another perspective, the invention involves making available different products with similar visible aesthetic properties. The visible aesthetic property may include any treatment recognizable to the consumer, which the consumer would then associate with another product containing a similar treatment. The visible aesthetic property may take the form of fabric patterns, color patterns, fur, faux fur, embossing, printing, silk screening, appliqués, stickers, or any other mechanism capable of conveying a visual property. Similar aesthetic properties may be achieved with differing mechanisms, for example, on one product, the aesthetic property may take the form of a fabric pattern or fur, while on a matching product the fabric pattern or fur may be reproduced with a printing technique.

The invention may include cooperating with a purveyor of clothing to enable distribution of a clothing product having a visible aesthetic property similar to the visible aesthetic property of the cosmetic product, and to thereby promote distribution of at least one of said product through distribution of the other of said products. In most instances, by simply cooperating to incorporate similar visible aesthetic properties in two products and by making consumers aware of the same, promotion will inherently occur. Nevertheless, as embodied herein, the cooperating may involve varying parties and may take differing forms. For example, the purveyors of the different products may be separate, unrelated companies, may be related companies, or may be separate groups within the same company. The mechanism for cooperating may range from a formal written agreement to an informal oral understanding. And the extent of the cooperation may run the gamut from a fully integrated joint marketing/promotional campaign to a loose understanding that each entity will employ a similar visible aesthetic property in its respective product(s), regardless of the fact that the products may or may not be sold together, and may or may not be sold under the same brand name or trademark. The fact that the two purveyors cooperate, inherently enables each to distribute a product with aesthetic properties similar to that of the other's.

In accordance with an exemplary embodiment of the invention, a method may include notifying a purchaser of the cosmetic product and/or the clothing product about the existence of the other of the cosmetic product and the clothing product, the notification advising the purchaser that the cosmetic product and the clothing product have similar aesthetic properties. As embodied herein, the purchaser may be provided with the notification through any one of the mechanisms discussed earlier including, but not limited to, product labels, or displays that may be provided by the manufacturer and displayed to the purchaser at the point of sale. For example, the manufacturer may attach labels to the product thereby providing the purchaser with notification. Alternatively, the manufacturer/distributor may provide notification to the purchaser by providing point of sale display signs to the retailer.

While the invention is discussed in connection with cosmetic and non-cosmetic products, in its broader sense, as mentioned earlier, the invention is not so limited, and may even include using a common visible aesthetic property to promote sales of functionally unrelated products (e.g., products that are not typically used to further the same function). As with the previous example, the purveyor(s) of the first and second products may incorporate a common visible aesthetic property into the products with the intention of causing consumers who view one of the products to visually associate them with each other. Further, the purveyor(s) of the first and second products might notify consumers who purchase at least one of the products of the existence of the other product. The concepts discussed in connection with previous embodiments apply equally to this embodiment and therefore are not repeated.

Depending on how the invention is embodied, it may assist purveyors of two different products to obtain access to the other's market niche. For example, a first brand name manufacturer may be able to increase market share by using the invention to cooperate with another manufacturer who is not necessarily a competitor. This may provide a win—win situation since the cooperation between two companies who may not directly compete with each other may allow each company to promote the other's product(s) without posing a risk to existing market share.

While the precise construction of the cosmetics container is not limiting to the invention in its broader sense, in one embodiment, the cosmetics container may be made of a foam covered by another material. Examples are illustrated in cross-section in FIGS. 5B and 6B where foam material 101 and 141 are respectively covered by fabric material 103 and 143.

Various foams and covering materials may be used, and therefore, the mention of particular materials herein is not intended to limit the invention in its broadest sense. By way of example, the foam may be polyethylene, polyurethane or polystyrene, and the covering material may be a material such as lycra. The fabric may be bonded to the foam material by heat and/or glue. Alternatively, the foam may not be covered at all, or may simply be imprinted or embossed with a visual aesthetic property.

Depending on construction, a foam core may enable certain features. For example, foam may protect the contents of the container from breakage. Foam may also be lighter than other materials traditionally used for cosmetic cases, enabling a weight savings in hand bags or purses.

Figure 16:
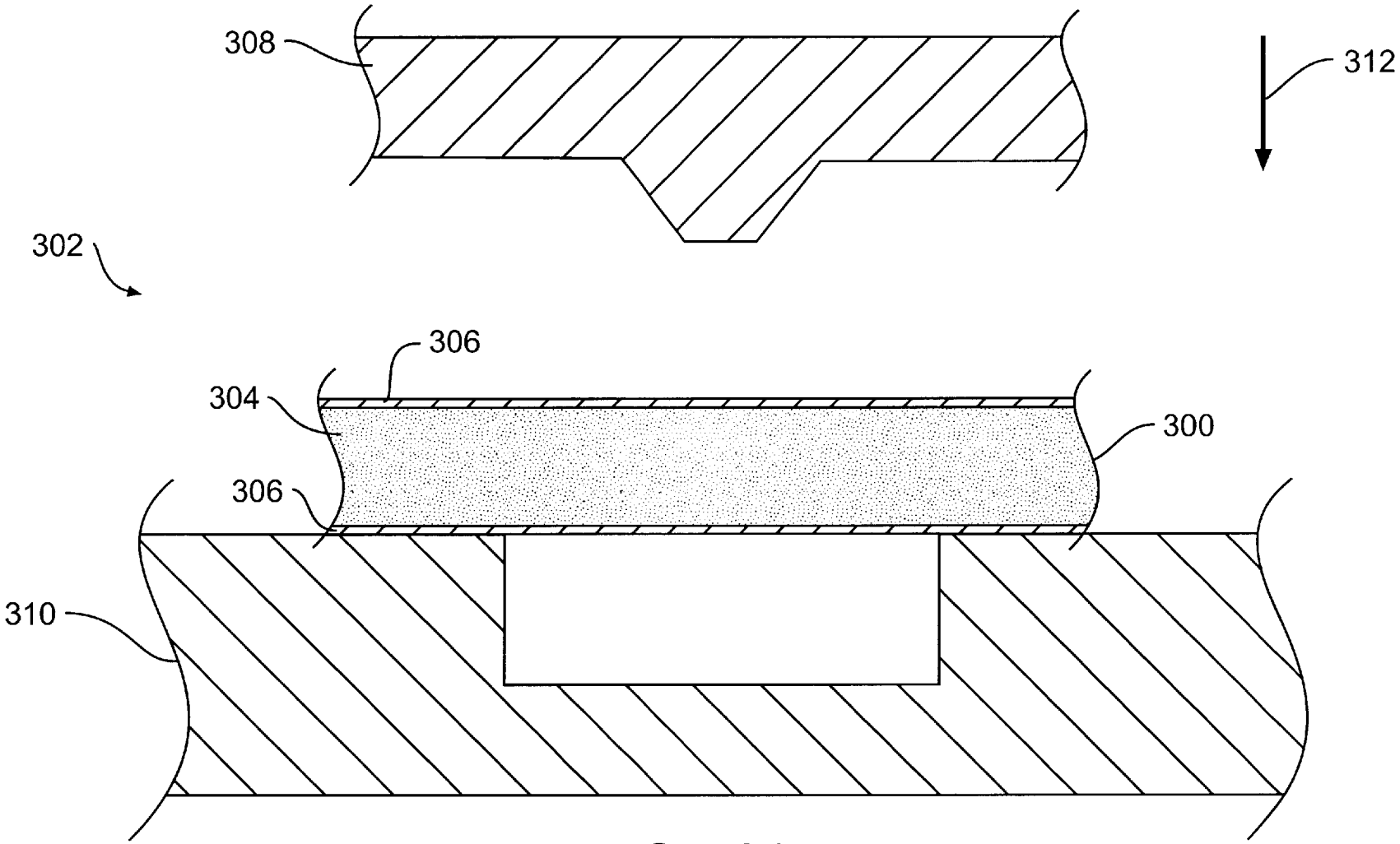
FIGS. 16 and 17 illustrate cosmetic product manufacturing process in accordance with the present invention.

To manufacture a foam core cosmetics container, a blank 300 may be inserted into a molding device 302, as illustrated in FIG. 16. The blank 300 may be an uncovered piece of foam, or a piece of foam covered on one or both sides with an aesthetic material such as fabric, facsimile of fabric, animal skin, or imitation animal skin. As illustrated by way of example in FIG. 16, foam core 304 is covered on each side with fabric layers 306.

Figure 17:
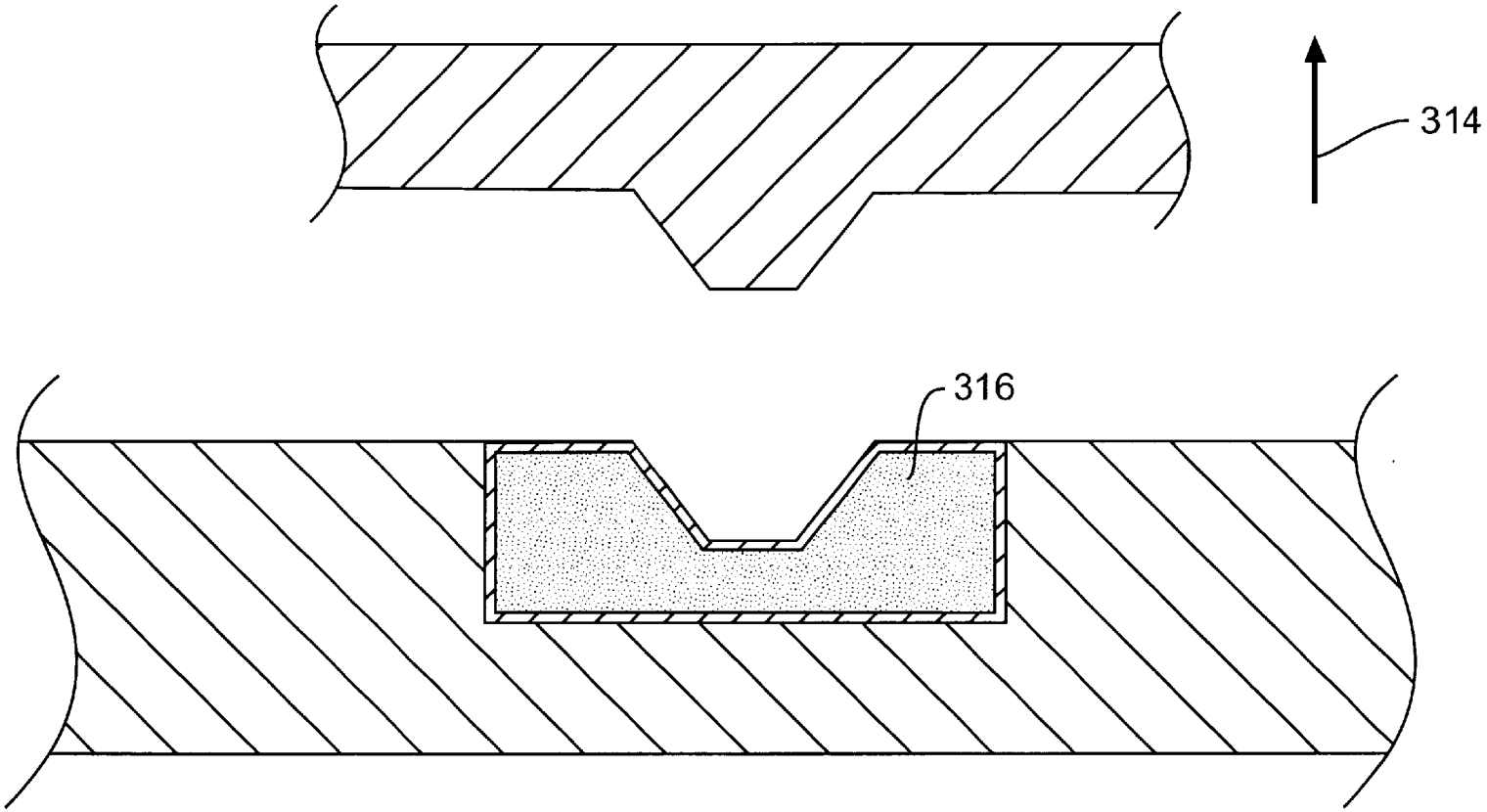

In FIG. 16, a die 308 is positioned on one side of the blank 300 and a mating shaping member 310 on the other. As reflected by the arrow 312 in FIG. 16, the die 308 and shaping member 310 move together forming the cosmetic container by pressure. Depending on the materials used, heat may be applied to the die and/or the shaping member to aid in the formation process. When the die 308 and shaping member 310 separate as indicated by the arrow 314 in FIG. 17, the finished product 316 is revealed, the edges of which may require trimming to remove excess material (not illustrated in FIG. 17.)

During the molding process described above, the molding materials are subjected to deforming pressure. Therefore, depending on the amount of deformation required, it may be beneficial to employ a fabric stretchable in multiple directions without tearing. Lycra is an example of one such fabric.

The shaping member/die may be configured to form one or more recesses in the foam (or material covered foam). One such recess may be configured to contain and surround a cosmetic composition. The cosmetic composition may be, for example, in powder cake form, such as a blush or rouge. The powder cake may itself be contained within a tray to prevent damage to the cake, and the cosmetic composition so configured may itself be surrounded by and contained within a recess in the foam. Such a construction not only may provide favorable aesthetics, but may also serve to protect the cosmetic product from damage.

Similarly, a recess may be provided to contain a mirror. As with the recess for the cosmetics composition, the mirror recess may surround the edges of a mirror embedded therein. This too may protect the mirror from breakage and may provide a favorable aesthetic quality to the cosmetic case.

A further recess may be provided as a holder for a cosmetic applicator. The recess may be sized to enable the applicator to be easily removed for use, and stored in the recess when not in use. Applicator details are discussed earlier in connection with FIGS. 3 and 4.

As also discussed previously, the cosmetic product may include a base and a cover (such as cover 102 and base 104 in FIG. 3). When formed of foam material, base and cover may be molded together from a single blank 300. The die/shaping member may be configured to form a thinned region between the cover and the base to serve as a hinge. In such an instance, the hinge may be covered with the covering material 306. Alternatively, the base and cover may be molded separately and later connected to each other.

After the molding process is complete, a closure mechanism may be added. For example, male and female ends of a snap may be embedded within lips of the cover and base so that in a closed position, the cover and base snap together (see, e.g., elements 150 and 152 in FIG. 4). Alternatively, and as illustrated by way of example in connection with FIG. 3, an elongated closure mechanism 122 may be formed during the molding process and used to carry one half of a snap 124 or another closure mechanism, such as those discussed previously. The elongated closure mechanism is illustrated as being fixedly connected to the base 104. However, it could alternatively be fixedly connected to the cover 102.

The manufacture of foam products is discussed, for example, in French Patent Publication FR 2674183-A1, dated Mar. 21, 1991, the technical disclosure of which is incorporated herein by reference. In addition, foam core article construction is discussed in concurrently filed U.S. provisional application entitled, "Device For Applying a Product Such as a Cosmetic or Care Product" [Attorney Docket No. 05725.6034], the technical disclosure of which is also incorporated herein by reference. In addition to die based molding processes, injection molding processes or other processes for forming or shaping foam may also be used in connection with the invention. Thus, the invention, in its broadest sense, is not restricted to a particular manufacturing process.

The location and number of recesses within the foam container may be a matter of design choice. For example, multiple recesses may be formed to contain differing cosmetic compositions, differing applicators, or for other uses. In addition, where appropriate, recesses may be omitted for an applicator or mirror.

In accordance with another exemplary embodiment, a method is provided for enabling a consumer to customize the appearance of a cosmetic product container. The method includes supplying information regarding a plurality of differing cosmetic compositions so that a consumer may select a specific cosmetic composition to be applied to an external body portion, such as the skin and/or hair. For example, the information might include a first set of information regarding particular groups of products, such as eye shadows, nail varnishes, blushes, mascaras, etc., a second set of information regarding particular brand names associated with sets of products available for each of the product groupings, and a third set of information regarding the specific products (e.g., particular colors and/or shades) available for each brand of product sets.

Information may be received regarding the cosmetic composition selected by the consumer, and the consumer may supplied with information regarding a plurality of differing visible aesthetic properties so that a consumer may select a visible aesthetic property to be located on a container for the selected cosmetic composition. Once information regarding the selected aesthetic property is received, activity takes place to cause the consumer to receive a cosmetic product having the selected cosmetic composition in a container with the customer-selected visible aesthetic property.

The product may be custom-configured after the customer's order is received, or, alternatively, various combinations of options may be maintained in stock so that the customer's order may be filled from stock. Regardless, the method may provide the customer with a sense of customization.

The information could be supplied, conveyed, and received in any known manner including any form of electronic communication, such as a telephone conversation, an e-mail message, a website on an electronic network, and/or a facsimile transmission. The information could also be sent via any non-electronic communication means, such as conventional postal delivery.

The activity for causing the consumer to receive the cosmetic product might include one or more of the following: placement of a shipping order, packaging of the cosmetic product, printing of a shipping label, and/or delivery to the consumer. In addition, the customer could be provided with an offer to purchase the product or information about how the product could be purchased.

The cosmetic product could be configured in the form of any of the cosmetic products described above and a visible portion of the cosmetic product could include material having the selected visible aesthetic property. The method might also include engaging in activity causing the customer to receive a separate sample of material having the selected visible aesthetic property. For example, the sample of material could be shipped with the cosmetic product or the sample of material could be shipped separately. Such a material sample might induce sales of a non-cosmetic products formed of the material.

Optionally, the method could include providing the consumer with a notification informing the consumer about an opportunity to purchase an article of clothing or other non-cosmetic product having the selected visible aesthetic property.

Figure 18:
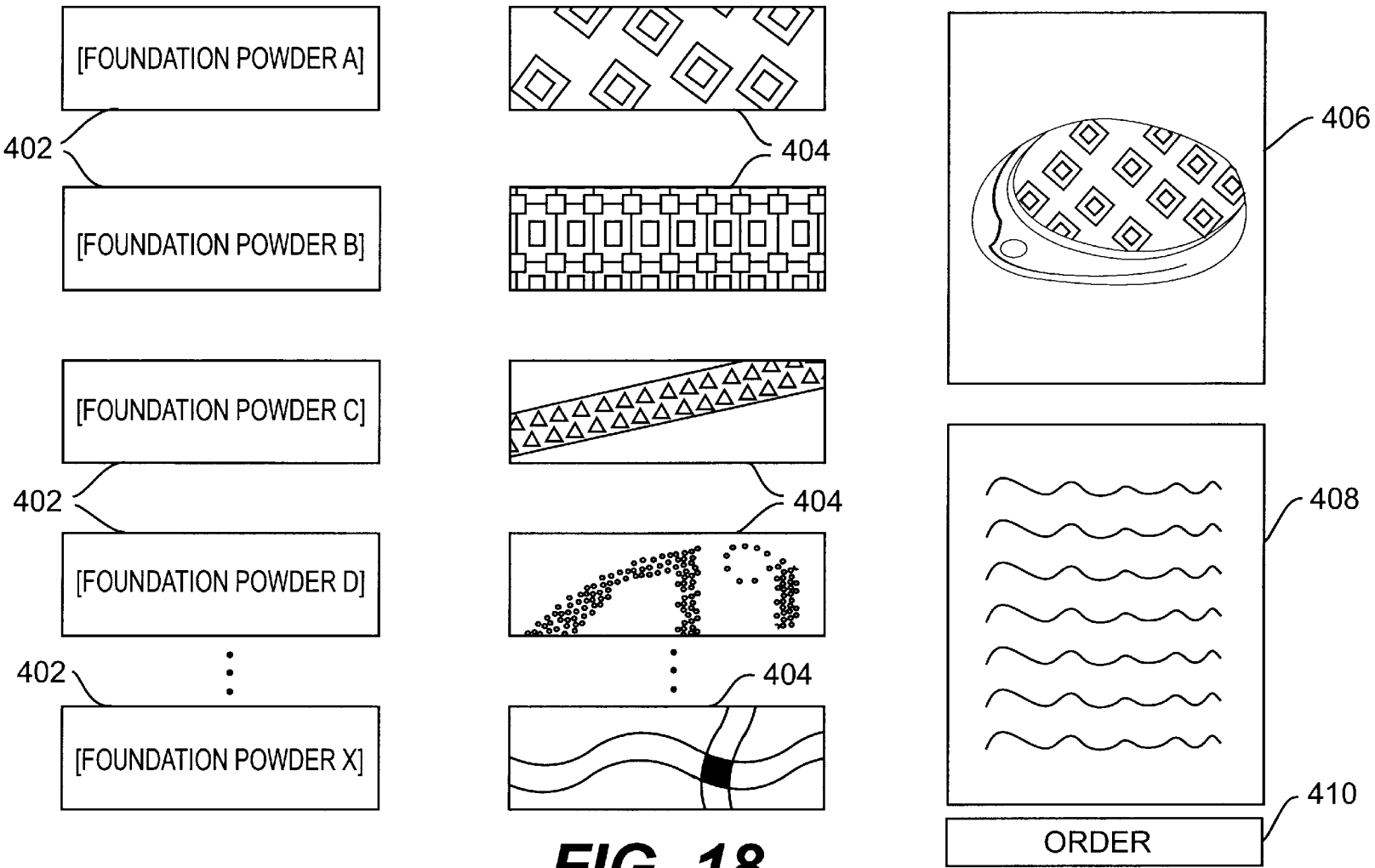
FIG. 18 illustrates a schematic example of a screen display associated with an electronic network, wherein the screen display is arranged to convey information relating to customizing the appearance of a cosmetic product.

FIG. 18 shows a schematic example of a screen display associated with an electronic network, such as the internet, wherein the screen display is configured to accomplish at least some of the aspects the cosmetic product customizing method. As shown in this figure, the screen display includes a group of cosmetic composition selectors 402, a group of material appearance selectors 404, a display area 406, a notification area 408, and an ordering selector 410.

Each cosmetic composition selector 402 may relate to a specific cosmetic composition differing from the cosmetic compositions of the other selectors 302. For example, as illustrated, each selector 402 represents a different shade of foundation powder. Similarly, if the display of FIG. 18 were to be configured for a particular brand name of eye shadow, each cosmetic composition selector might be a specific color and/or shadow of a specific eye shadow product capable of being selected by a consumer.

Each material appearance selector 404 may relate to a material having a differing visual appearance. When a user selects one of the selectors 404, the display area 406 could be configured to display an image of a cosmetic container including a visual portion with the selected material. Activation of the ordering selector 410 could cause send ordering information regarding the specific cosmetic composition and material appearance selected by the consumer. Actions could then be taken to cause the consumer to receive the send the consumer a cosmetic product including the selected composition within a container including the selected appearance.

The notification area 408 could provide a notification about how the consumer would be able to purchase a non-cosmetic product, such as an article of clothing, having a visible portion with material resembling the selected pattern. The notification provided in notification area 408 could be mere written information describing at least one brick and mortar store where the non-cosmetic product could be purchase the non-cosmetic product. Alternatively, or in addition, the notification area 408 could provide a link to another display area or network where a consumer could obtain such information and/or purchase the non-cosmetic product electronically. Optionally, the display area 406 could be configured to display an image of the non-cosmetic product with the selected material.

For expedience of disclosure, the invention is discussed in connection with first and second products. It is to be understood that this includes two or more products. For example, a set of related and/or unrelated products may share similar visible aesthetic properties.

In the foregoing Description of Exemplary Embodiments, various features are grouped together in a single embodiment for purposes of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Description of the Exemplary Embodiments, with each claim standing on its own as a separate embodiment of the invention.

What is claimed is:

1. A cosmetic product combination, comprising:

a cosmetic container;

a region within the cosmetic container, the region being configured to contain at least one cosmetic composition;

at least one cosmetic composition located within the region;

an applicator removably located within at least a portion of the container, the applicator having a portion configured to be loaded with the cosmetic composition; and a visible aesthetic property located on a visible portion of the cosmetic container, the aesthetic property being arranged on the cosmetic container to simulate a visible aesthetic property of a clothing product, the aesthetic property of the cosmetic container being configured to cause consumers who purchase one of the clothing product and the cosmetic container to recognize a match and to be inclined to purchase the other of the clothing product and the cosmetic container.

2. The cosmetic product combination of claim 1, wherein the cosmetic composition comprises at least one of perfume, cologne, lipstick, mascara, lip gloss, blush, rouge, eye liner, foundation, powder, powder cake, nail varnish, eye shadow, and concealer.

3. The cosmetic product combination of claim 1, further comprising a notification associated with the cosmetic container, the notification advising customers of an existence of the clothing product with a matching visible aesthetic property.

4. The cosmetic product combination of claim 3, wherein the notification comprises a label attached to the cosmetic container.

5. The cosmetic product combination of claim 3, wherein the notification comprises a notice for display to consumers at a point of sale.

6. The cosmetic product combination of claim 3, wherein the notification comprises a broadcasted advertisement that refers to both the cosmetic product and the clothing product.

7. The cosmetic product combination of claim 3, wherein the notification includes an incentive to the purchaser to obtain said other product.

8. The cosmetic product combination of claim 3, wherein the notification includes a coupon for purchase of the clothing product.

9. The cosmetic product combination of claim 3, wherein the notification includes an offer to purchase the clothing product at a discounted price.

10. The cosmetic product combination of claim 3, wherein the notification includes an offer to receive the clothing product free of charge.

11. The cosmetic product combination of claim 1, wherein the cosmetic container is marked with a brand name that differs from a brand name marked on the clothing product.

12. A method comprising:

making available the cosmetic product combination of claim 1, wherein the visible aesthetic property of the cosmetic container is achieved using a first material chosen from fabric, facsimile of fabric, animal skin, and imitation animal skin; and making available a non-cosmetic product incorporating a second material resembling the first material, the second material being chosen from fabric, facsimile of fabric, animal skin, and imitation animal skin.

13. The cosmetic product combination of claim 1, wherein the cosmetic container is marked with a brand name that differs from a brand name marked on the non-cosmetic product.

14. The cosmetic product combination of claim 1, wherein the cosmetic container comprises a cosmetic compact.

15. A cosmetic product combination, comprising:

a cosmetic container;

a region within the cosmetic container, the region being configured to contain at least one cosmetic composition; and a visible aesthetic property located on a visible portion of the cosmetic container, the aesthetic property being arranged on the cosmetic container to simulate a visible aesthetic property of a non-cosmetic product, the aesthetic property of the cosmetic container being configured to cause consumers who purchase one of the non-cosmetic product and the cosmetic container to recognize a match and to be inclined to purchase the other of the non-cosmetic product and the cosmetic container.

16. The cosmetic product combination of claim 15, wherein the container is configured to hold at least one of perfume, cologne, lipstick, mascara, lip gloss, blush, rouge, eye liner, foundation, powder, powder cake, nail varnish, eye shadow, and concealer.

17. The cosmetic product combination of claim 15, further comprising a notification associated with the cosmetic container, the notification advising customers of an existence of the non-cosmetic product with a matching visible aesthetic property.

18. The cosmetic product combination of claim 17, wherein the notification comprises a label attached to the cosmetic container.

19. The cosmetic product combination of claim 17, wherein the notification comprises a notice for display to consumers at a point of sale.

20. The cosmetic product combination of claim 17, wherein the notification comprises a broadcasted advertisement that refers to both the cosmetic product and the non-cosmetic product.

21. The cosmetic product combination of claim 17, wherein the notification includes an incentive to the purchaser to obtain said other product.

22. The cosmetic product combination of claim 17, wherein the notification includes a coupon for purchase of the non-cosmetic product.

23. The cosmetic product combination of claim 17, wherein the notification includes an offer to purchase the non-cosmetic product at a discounted price.

24. The cosmetic product combination of claim 17, wherein the notification includes an offer to receive the non-cosmetic product free of charge.

25. A method comprising:

making available the cosmetic product combination of claim 15, wherein the visible aesthetic property of the cosmetic container is achieved using a first material chosen from fabric, facsimile of fabric, animal skin, and imitation animal skin; and making available a non-cosmetic product incorporating a second material resembling the first material, the second material being chosen from fabric, facsimile of fabric, animal skin, and imitation animal skin.

26. The cosmetic product combination of claim 15, wherein the cosmetic container comprises a cosmetic compact.

27. A method, comprising:

making available a cosmetic product defining at least one internal region configured to surround and contain least one cosmetic composition, wherein a visible portion of the cosmetic product includes a first material chosen from fabric, facsimile of fabric, animal skin, and imitation animal skin; and making available a non-cosmetic product having a visible portion including a second material chosen from fabric, facsimile of fabric, animal skin, and imitation animal skin; and wherein the first material has an appearance resembling an appearance of the second material.

28. The method of claim 27, wherein the cosmetic product further comprises said at least one cosmetic composition, and wherein the cosmetic composition is chosen from perfume, cologne, lipstick, mascara, lip gloss, blush, rouge, eye liner, foundation, powder, powder cake, nail varnish, eye shadow, and concealer.

29. The method of claim 27, wherein the internal region is configured to contain a liquid.

30. The method of claim 27, wherein the cosmetic product further comprises a cosmetic applicator having an application portion configured to be loaded with the cosmetic composition.

31. The method of claim 27, wherein the cosmetic product further comprises a portion configured to receive and removably hold the cosmetic applicator.

32. The method of claim 27, wherein the cosmetic product comprises a foam core portion and wherein the second material covers at least a portion of the foam core.

33. The method of claim 27, wherein the cosmetic product is marked with a brand name differing from a brand name marked on the non-cosmetic product.

34. The method of claim 27, comprising establishing a marketing link between the cosmetic product and the non-cosmetic product.

35. The method of claim 34, wherein the marketing link includes referring to both the cosmetic product and the non-cosmetic product within at least one advertisement.

36. The method of claim 35, wherein the advertisement is a product label for one or more of the cosmetic product and the non-cosmetic product.

37. The method of claim 35, wherein the advertisement is a notice at the point of sale of one or more of the cosmetic product and the non-cosmetic product.

38. The method of claim 27, wherein the first and second materials are substantially identical.

39. The method of claim 27, further comprising selling the cosmetic product and the non-cosmetic product as an ensemble.

40. The method of claim 27, further comprising notifying a consumer who purchases one of the cosmetic product and the non-cosmetic product of an existence of the other of said products.

41. The method of claim 27, wherein the first material and the second material resemble each other in one or more of color, pattern and texture.

42. The method of claim 27, wherein the cosmetic product comprises a cosmetic compact.

43. A combination, comprising:

a non-cosmetic product having a visible portion including a first material chosen from fabric, facsimile of fabric, animal skin, and imitation animal skin; and a cosmetic product defining at least one internal region configured to surround and contain least one cosmetic composition, wherein a visible portion of the cosmetic product includes a second material chosen from fabric, facsimile of fabric, animal skin, and imitation animal skin, wherein the first material has an appearance resembling an appearance of the second material.

44. The combination of claim 43, wherein the first and second materials are substantially identical.

45. The combination of claim 43, wherein the non-cosmetic product is chosen from a clothing article, shoes, a jacket, a skirt, a dress, slacks, pants, socks, a shirt, a blouse, a bathing suit, a suit, a tie, an undergarment, and a hat.

46. The combination of claim 43, wherein the non-cosmetic product is chosen from a fashion accessory, a purse, a belt, a bag, a scarf, jewelry, a watch, a hair accessory, a head band, a hair clip, a beret, and a hair scrunchie.

47. The combination of claim 43, wherein the non-cosmetic product is chosen from a sporting equipment carrier, a golf bag, and a racket bag.

48. The combination of claim 43, wherein the non-cosmetic product is chosen from luggage, a car seat, a towel, a bedding item, a sheet, a blanket and a toiletry bag.

49. The combination of claim 43, wherein the cosmetic product further comprises the cosmetic composition, and wherein the cosmetic composition is chosen from perfume, cologne, lipstick, mascara, lip gloss, blush, rouge, eye liner, foundation, powder, powder cake, nail varnish, eye shadow, and concealer.

50. The combination of claim 43, wherein the cosmetic product is marked with a brand name differing from a brand name of the non-cosmetic product.

51. The combination of claim 43, wherein the cosmetic product and the non-cosmetic product are typically offered for sale in differing locations.

52. The combination of claim 43, wherein the cosmetic product and the non-cosmetic product are sold as an ensemble.

53. The combination of claim 43, wherein the region is configured to contain a liquid.

54. The combination of claim 43, wherein the cosmetic product further comprises a cosmetic applicator having an application portion configured to be loaded with the cosmetic composition.

55. The combination of claim 54, wherein the cosmetic product further comprises a portion configured to receive and removably hold the cosmetic applicator.

56. The combination of claim 43, wherein the cosmetic product comprises at least a portion formed of foam.

57. The combination of claim 56, wherein the second material is fixedly attached to the foam.

58. The combination of claim 43, wherein the cosmetic product comprises a body defining the region and wherein the second material is fixedly attached to the body.

59. The combination of claim 58, wherein the cosmetic product further comprises the cosmetic composition, wherein the cosmetic composition is contained in the internal region.

60. The combination of claim 59, wherein the cosmetic product comprises a first and a second part movable with respect to one another to place the cosmetic product in a position permitting access to the cosmetic composition.

61. The combination of claim 43, wherein the cosmetic product and the non-cosmetic product are marked with a single commonly owned trademark.

62. The combination of claim 43, wherein the cosmetic product comprises a cosmetic compact.

63. A cosmetic product, comprising:

a container base including a foam core, the core having at least one recess therein for containing a cosmetic composition;

a container cover configured to cover at least the recess; and an outer layer covering at least a portion of at least one of the base and the cover, wherein the outer layer is chosen from fabric, facsimile of fabric, animal skin, and imitation animal skin, and wherein the outer layer has a visible aesthetic property simulating a visible aesthetic property of a non-cosmetic product, so that consumers associate the cosmetic product and the non-cosmetic product with one another.

64. The cosmetic product of claim 63, further comprising a cosmetic composition in the recess.

65. The cosmetic product of claim 64, wherein the cosmetic composition is a powder cake, and wherein foam of the core is configured to surround at least a portion of the powder cake.

66. The cosmetic product of claim 63, further comprising a mirror provided on one of the container base and the container cover.

67. The cosmetic product of claim 63, further comprising an applicator for the cosmetic composition, wherein the container base is configured to removably hold the applicator.

68. The cosmetic product of claim 63, wherein the cosmetic product comprises a cosmetic compact.

69. A cosmetic product, comprising:

a cosmetic container;

a region within the cosmetic container, the region being configured to contain at least one cosmetic composition; and a visible aesthetic property located on a visible portion of the cosmetic container, the aesthetic property simulating a visible aesthetic property of a clothing product, the aesthetic properties of the cosmetic product and the clothing product being chosen so that consumers who purchase one of the clothing product and the cosmetic product will recognize a match and be inclined to purchase the other of the clothing product and the cosmetic product.

70. The cosmetic product of claim 69, wherein the cosmetic container comprises a cosmetic compact.

71. A cosmetic product, comprising:

a container having a recess therein;

a cosmetic composition contained in the recess;

an applicator configured to apply the cosmetic composition, the applicator being configured to be contained within the container;

a visible aesthetic property on the container, wherein the aesthetic property is substantially similar to a visible aesthetic property of an article of clothing, wherein the container with the visible aesthetic property thereon is configured to cause a consumer to visually associate the cosmetic product with the article of clothing.

72. The cosmetic product of claim 71, wherein the container comprises a cosmetic compact.

73. A clothing product, comprising:

an article of clothing; and an aesthetic property provided to the article of clothing on a visible portion thereof, the aesthetic property simulating a visible aesthetic property of a cosmetic product, the aesthetic property of the article of clothing being chosen so that consumers who purchase one of the clothing product and the cosmetic product will recognize a match and be inclined to purchase the other of the clothing product and the cosmetic product.

74. The clothing product of claim 73, wherein the cosmetic product comprises a cosmetic compact.

75. A cosmetic product, comprising:

a foam core;

at least one recess located within the foam core, the at least one recess being configured to contain a cosmetic composition therein; and a material at least partially covering the foam core, the material being chosen from fabric, facsimile of fabric, animal skin, and imitation animal skin, wherein the material imparts an aesthetic quality to the cosmetic product.

76. The cosmetic product of claim 75, further comprising a cosmetic composition in the recess.

77. The cosmetic product of claim 75, wherein the cosmetic composition is a powder cake and wherein the core is configured to surround at least a portion of the powder cake.

78. The cosmetic product of claim 75, further comprising a mirror provided in the core so that foam of the core surrounds edges of the mirror.

79. The cosmetic product of claim 75, further comprises at least one removable cosmetic applicator, and at least one applicator recess in the foam core, the applicator recess being configured so that foam surrounds and removably holds the applicator.

80. The cosmetic product of claim 75, wherein the cosmetic composition comprises a powder cake, and wherein the cosmetic product further comprises a tray positioned between the foam core and the powder cake.

81. The cosmetic product of claim 75, wherein the cosmetic product comprises a cosmetic compact.

82. A cosmetic product, comprising:

a foam core;

recesses located in the foam core, wherein the recesses comprise a recess housing a cosmetic composition, a recess containing a mirror, and a recess removably holding an applicator, wherein foam of the core surrounds edges of the mirror; and a material covering at least a portion of the foam core, the material being chosen from fabric, facsimile of the fabric, animal skin, and imitation animal skin wherein the material imparts the cosmetic product with a visible aesthetic affect.

83. The cosmetic product of claim 82, wherein the foam core includes a base and a cover.

84. The cosmetic product of claim 83, wherein the base and the cover are connected by foam.

85. The cosmetic product of claim 83, wherein the base and the cover are connected by the fabric material.

86. The cosmetic product of claim 83, including a hinge connecting the base and the cover, the hinge rendering the cover selectively movable between open and closed positions, the cosmetic product further including a closure for selectively holding the cover in the closed position.

87. The cosmetic product of claim 86, wherein the closure includes a snap mechanism and wherein at least a portion of the snap mechanism is embedded within foam of the core.

88. The cosmetic product of claim 82, wherein the cosmetic product comprises a cosmetic compact.

* * * * *

UNITED STATES PATENT AND TRADEMARK OFFICE

CERTIFICATE OF CORRECTION

PATENT NO. : 6,857,432 B2
DATED : February 22, 2005
INVENTOR(S) : Vincent de Laforcade It is certified that error appears in the above-identified patent and that said Letters Patent is hereby corrected as shown below:

Title page,
Item [54], Title, delete "PRODUCT".
Item [57], ABSTRACT,
Line 7, "contain least" should read -- contain at least --.

Column 13,
Line 22, "contain least" should read -- contain at least --.

Column 14,
Line 18, "contain least" should read -- contain at least --.

Signed and Sealed this

Tenth Day of May, 2005

JON W. DUDAS
*Director of the United States Patent and Trademark Office*